US005375349A

United States Patent [19]

Jochim

[11] Patent Number: 5,375,349

[45] Date of Patent: Dec. 27, 1994

[54] WING ASSEMBLY FOR MOLDBOARDS OF GRADERS AND OTHER MATERIAL MOVING EQUIPMENT

[76] Inventor: Eric M. Jochim, 6359 W. Dry Creek Rd., Healdsburg, Calif. 95448

[21] Appl. No.: 49,901

[22] Filed: Apr. 20, 1993

[51] Int. Cl.[5] ..... E01H 5/00

[52] U.S. Cl. ..... 37/429; 37/409; 37/903; 37/281

[58] Field of Search ..... 37/412, 417, 427, 429, 37/448, 449, 409, 903, 281

[56] References Cited

U.S. PATENT DOCUMENTS

| | | | |
|---|---|---|---|
| 2,515,384 | 7/1950 | Von Carnop | 37/409 |
| 2,841,897 | 7/1953 | Duke | 37/448 X |
| 2,988,831 | 6/1961 | Burns . | |
| 3,055,126 | 9/1962 | Emhof . | |
| 3,089,261 | 5/1963 | Flath | 37/449 X |
| 3,148,466 | 9/1964 | Batko . | |
| 3,373,515 | 3/1968 | Schneider . | |
| 3,430,706 | 3/1969 | Marron | 37/903 X |
| 3,807,064 | 4/1974 | Schmidt, Jr. | 37/28 X |
| 4,010,561 | 3/1977 | Klett | 37/448 |
| 4,208,812 | 6/1980 | Brownly . | |
| 4,741,116 | 5/1988 | Engle et al. . | |
| 4,962,600 | 10/1990 | Zellaha et al. . | |

*Primary Examiner*—Randolph A. Reese
*Assistant Examiner*—Spencer Warnick
*Attorney, Agent, or Firm*—Townsend and Townsend Khourie and Crew

[57] ABSTRACT

A side wing attachment assembly for moldboards includes hydraulically actuated, spaced wing plate members capable of being placed predetermined distances from one another, forming with the moldboard material moving surface a containment pocket for material to be moved or directed. The side wing assembly includes the ability to move the wing plate members away from the material moving surface of the moldboard, or repositioning the wing plates to accommodate reorientation of the moldboard material moving surface.

19 Claims, 5 Drawing Sheets

WING ASSEMBLY FOR MOLDBOARDS OF GRADERS AND OTHER MATERIAL MOVING EQUIPMENT

BACKGROUND OF THE INVENTION

The present invention relates generally to material moving equipment such as, for example, a grader, but can also be used with snow plows, and the like. More particularly, the invention relates to side wing attachment assemblies for moldboards or grader blades that, when in place, form a material moving pocket used for containment of material being moved, or to direct the material being moved.

There exists a variety of attachments to moldboards or grader blades that form, with the material moving (forward facing) surface of the moldboard, a pocket or cavity that operates to contain and/or direct material being moved. While certain of these attachments are capable of being repositioned to modify the pocket or directional surfaces so formed (see, for example, U.S. Pat. Nos. 2,988,831, 3,055,126, 4,208,812), none of these attachments permit any type of repositioning to take into consideration a changed attitude of the material moving surface of the moldboard, relative to the ground surface. For example, certain of these attachments form walls that extend from the ends of the moldboard, forming a pocket with the material (forward) surface of the moldboard. It is often desired to roll the moldboard about its longitudinal (horizontal) axis, in order to reposition the material moving surface of the moldboard (relative to ground surface) for greater or less ground surface penetration and/or to increase or decrease the ability of the moldboard to move material (e.g., earth). Such reorientation of the moldboard, often called "blade tilt," is frequently used for feathering material to obtain more ground penetration, as well as to permit operator viewing of the moldboard edge. When the moldboard includes side wing attachments of the type presently known, such wing attachments must be either removed or moved out of the way in some fashion when the moldboard is rolled forward on its axis, because the cutting edge of the wing member cannot be readily adjusted to accommodate the new orientation of moldboard material-moving surface. I such wing attachments are not moved or removed when the attitude of the moldboard is changed, the cutting edge of the attachment can dig too deep into the ground surface.

Further, it is often desirable to modify the pocket formed by the moldboard material moving surface and one or a pair of such wing attachments by repositioning the wing member attachment relative to the moldboard surface. Unfortunately, even if accommodated in the design of the wing member, this often requires manual movement away from or toward a vertical edge of the moldboard, a time consuming effort.

SUMMARY OF THE INVENTION

Accordingly, the present invention provides a wing member assembly with a cutting edge that can be maintained generally horizontally when the material moving surface of the moldboard is rolled forward or back about its longitudinal axis. At the same time, the wing member assembly maintains a its position relative to the material-moving surface of the moldboard in order to preserve the desired containment/directing pocket.

In the preferred embodiment of the invention, the wing assembly includes a pair of flat, wing plates releasably held together in parallel, juxtaposed relation by a hydraulically operated clamp mechanism. One of the wing plates is pivotally attached to a carriage. The carriage, in turn, is mounted proximate an upper periphery or edge of the moldboard, for movement therealong from a position adjacent one vertical edge of the moldboard, toward the other. A hydraulic motor mounts to the carriage for moving one of the wing plates in a plane that is perpendicular to a longitudinal of the moldboard so that the wing assembly can be moved into and out of positions with the moldboard, forming or removing the material-moving pocket.

One of the wing plates has an edge formed and configured to conform to the concave, or generally "C"-shaped, material-moving surface of the moldboard, and is positioned in confronting relation thereto. The other wing plate provides a generally linear cutting edge that is generally horizontally positionable. Releasing the mechanism that holds the two wing plates in fixed relation, and raising or lowering the one wing plate, permits the moldboard to be rolled about a longitudinal while, at the same time, positioning the cutting edge of the wing member generally parallel to the ground surface.

In a further embodiment of the invention, the carriage mechanism is mounted for movement along the upper periphery of the moldboard to position the wing plates inward, if desired, of the vertical edge of the moldboard, thereby allowing the material-containment pocket so formed to be varied. Two wing assemblies can be provided, one for each end of the moldboard, both of which have movable carriage members for moving the wing plates toward or away from one another. Repositioning the two wing assemblies along the moldboard, relative to one another, permits the material containment void formed between the two wing assemblies (and with the material-moving surface of the moldboard) to be varied.

In an additional embodiment of the invention, the wing plates are attached to the moldboard in a manner that allows them to be rotated away from their relationship with the moldboard when no longer needed.

A number of advantages of the present invention can now been seen. First, the split-plate construction of the wing member permits a cutting edge of the wing member to maintain a generally parallel attitude with the ground surface when the moldboard is reoriented (i.e., rolled), avoiding the cutting edge of the wing member from digging into the ground surface.

Another advantage of the present invention is that the material containing void may be modified in a number of ways: first, repositioning two wing plate members relative to one another will vary the containment pocket; second, moving one wing plate totally away and out of the pocket formation, in keeping the other wing member in place, permits a containment void that is directional insofar as movement of the material is concerned.

These, and other common advantages and aspects of the present invention will become apparent to those skilled in this art upon a reading of the following detailed description of the invention, which should be taken in conjunction with the accompanying drawings.

DESCRIPTION OF THE PREFERRED EMBODIMENT

Figure 1:
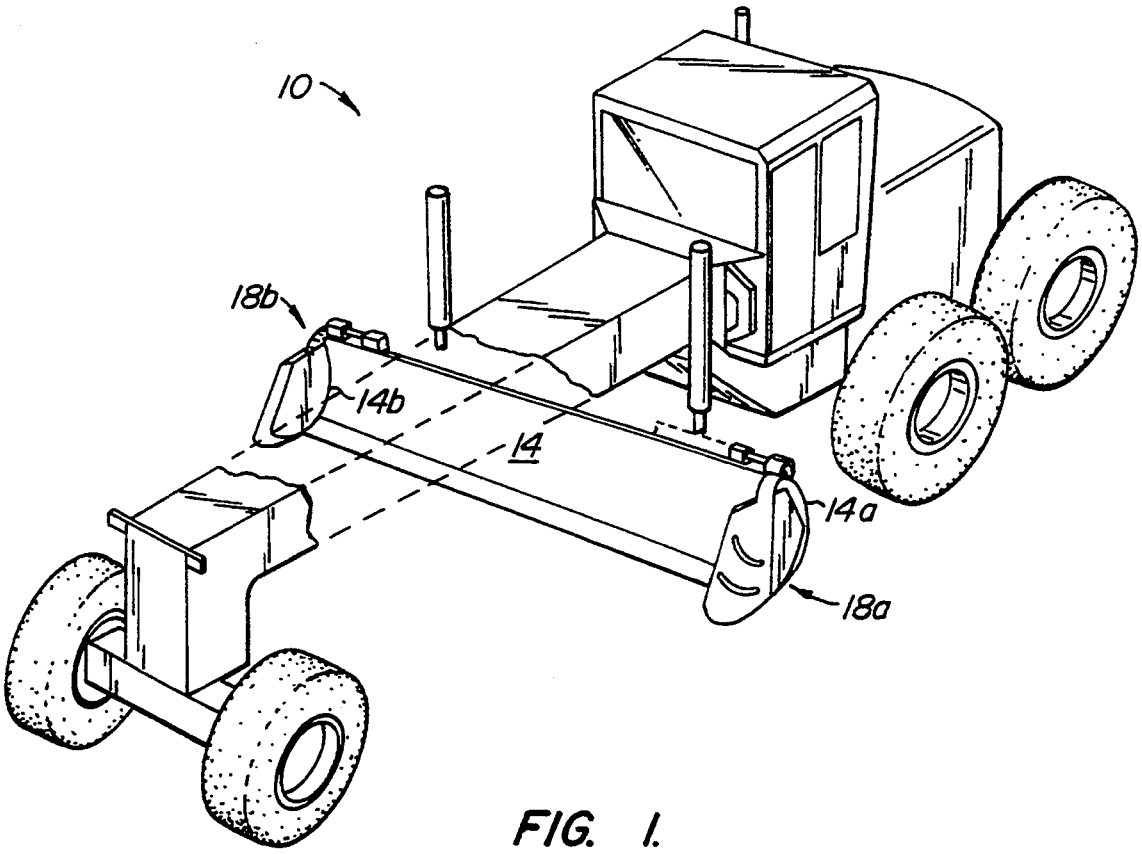
FIG. 1 is a perspective view of a pair of wing assemblies of the present invention mounted to a moldboard of a grader.

The present invention provides wing members for attachment to a moldboard of grader. However, it will be appreciated by those skilled in this art that the wing members of the present invention can be used on moldboards of other material moving equipment of a variety of types such as, for example, earth or snow moving equipment. It finds particular use, however, in connection with such as articulated graders as depicted in FIG. 1 (and in U.S. Pat. No. 2,148,466) or smaller vehicles as depicted in U.S. Pat. Nos. 4,208,812 or 4,714,116.

Turning, then, to the figures, and for the moment specifically FIG. 1, there is depicted a material moving vehicle (e.g., grader), designated generally with the reference numeral 10, that includes a moldboard 14. Attached adjacent each end **14*a*, 14*b* of the moldboard 14 is a wing assembly 18** constructed according to the teachings of the present invention.

Although, as illustrated in FIG. 1, the moldboard 14 carries a wing assembly 18 at each of its lateral ends, it may well be that only one is needed or desired, depending upon the circumstances. Thus, only one wing assembly 18 need be attached. However, it will be seen that even if the moldboard 14 is equipped with two wing assemblies 18, if circumstances are encountered so that only one wing assembly 18 is needed, the wing plates of the then un-needed assembly 18 can be moved out of the way so that the moldboard 14 can be used as if only one wing assembly 18 were attached.

Both wing assemblies 18 are substantially identical in construction, except as needed for mounting on one side or the other. This being so, a description of one wing assembly should be taken as applying equally to the other unless otherwise stated.

Figure 2:
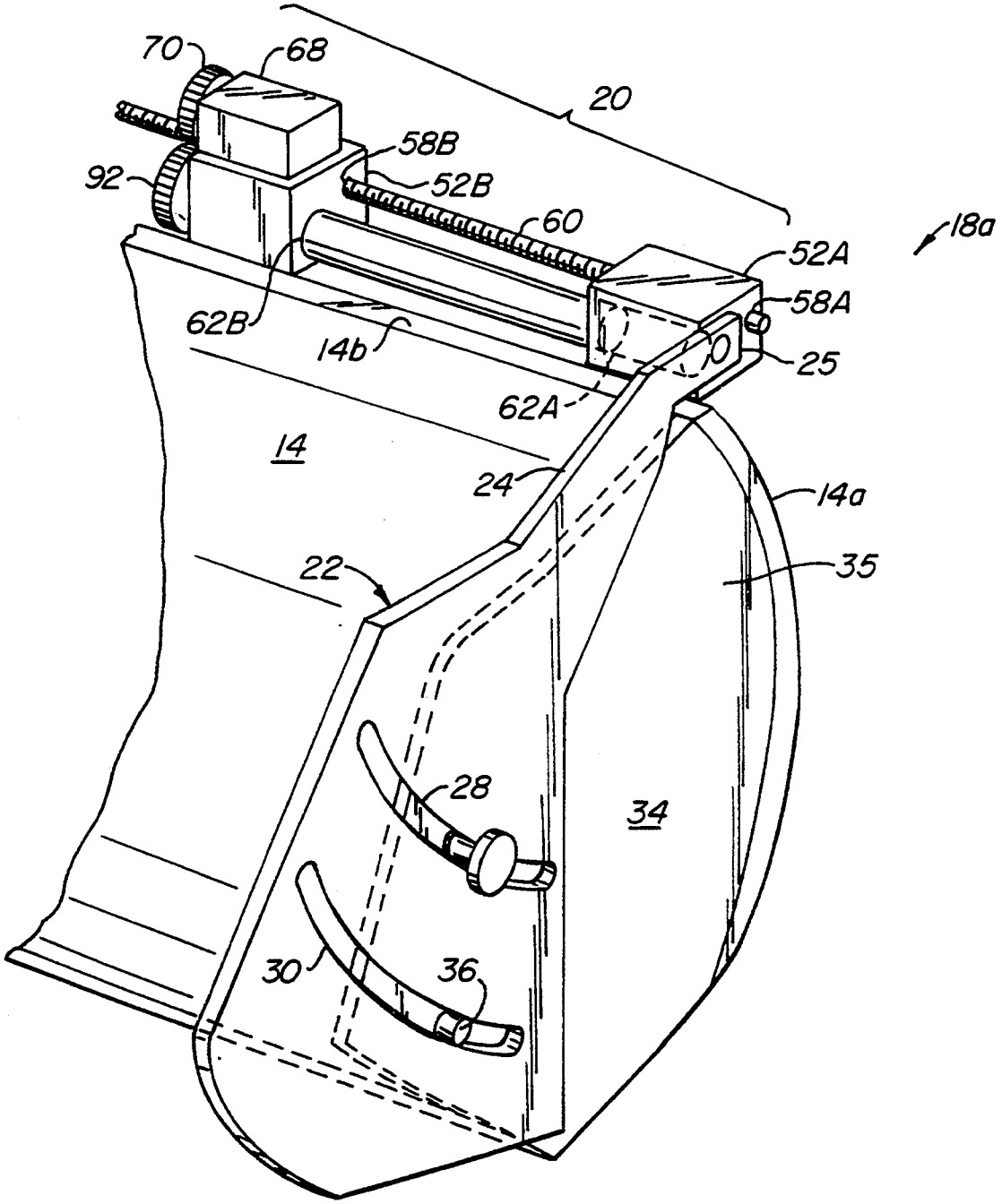
FIG. 2 is a perspective view of the wing assembly of the present invention.

As perhaps better illustrated in FIGS. 2 and 3, which illustrates the wing assembly **18*a*, the wing assembly includes a carriage mechanism 20 that carries a wing plate 22 by an attachment arm 24. The terminal end 25** of the attachment are is pivotally connected to the carriage mechanism.

Formed in the wing plate 20 are a pair of arcuate cutouts 28, 30, having radial center points coincident with that of the point of pivot of the journalled terminal end of the attachment arm 25. A lower edge 32 form a linearly configured cutting edge.

A second, flat wing plate 34 is positioned adjacent the wing plate 22. The wing plate 34 carries on its outer, laterally facing surface 35 guide posts 36 that are positioned and configured to be received by the cutouts 28, 30 formed in the wing plate 22. (Only one of the guide posts 36 are viewable, the other being obscured by a clamp mechanism 40.)

Figure 3B:
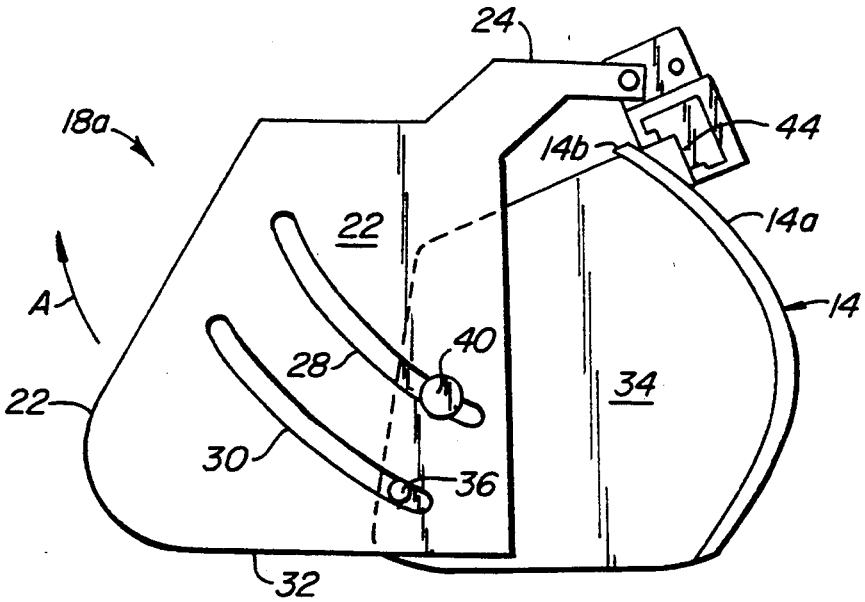
FIGS. 3A and 3B are side plane side views of the wing plates that form a part of the present invention, illustrating maintenance of a cutting edge of the wing plates for two orientations of the moldboard.

The wing plate 34 is carried by the wing plate 22, kept in relative position by the guide posts 36, and held thereto by the hydraulic clamp mechanism 40. When it is desired to re-orient the bottom or cutting edge 32 of the wing plate 22 to account for, perhaps, re-orientation of the moldboard (e.g., a rolling forward of the material-engaging surface of the moldboard), the wing plate 22 is lifted, or dropped accordingly. This is illustrated in FIGS. 3A and 3B.

Figure 3A:
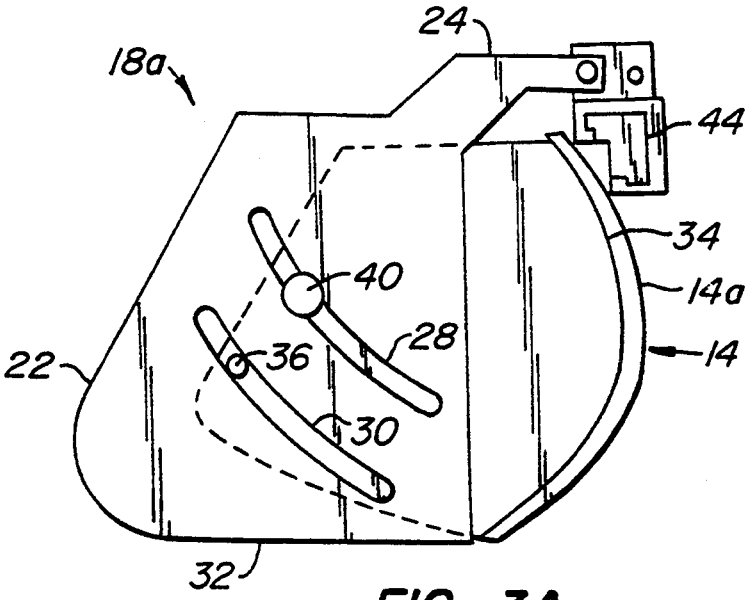

Referring first to FIG. 3A, the wing plate 22 is held in place so that the cutting edge 32 is generally if not substantially parallel with the ground surface (not shown). Suppose, the moldboard 14 is to be rolled forward about an axis parallel with a longitudinal of the moldboard, assuming an attitude as shown in FIG. 3B. If the wing plate 22 is not repositioned, the cutting edge 32 of the wing plate will be positioned to dig into the ground surface. Therefore, according to the present invention, preferably before the moldboard is re-oriented the clamp mechanism 40 is actuated to cause it to release its hold on the two wing plates 22, 34. The wing plate 22 is then lifted so that it rotates a distance in a direction indicated by the arrow A. The weight of the wing plate 34 will tend to place its curved rear edge held against the concave surface of the moldboard 14. (The curved rear edge of the wing plate 34 can be held securely against the concave surface of the moldboard by force exerted by the hydraulic motor 68, as described more fully below.) The guide posts 16 will ensure that the relative positions of the wing plates 22, 34 will be maintained. When the wing plate 22 has been lifted a desired amount—sufficient to that its cutting edge 32 will be generally parallel to the ground surface—the clamp mechanism is operated to cause it to clamp the two wing plates 22, 34 in fixed relation to one another.

Figure 4A:
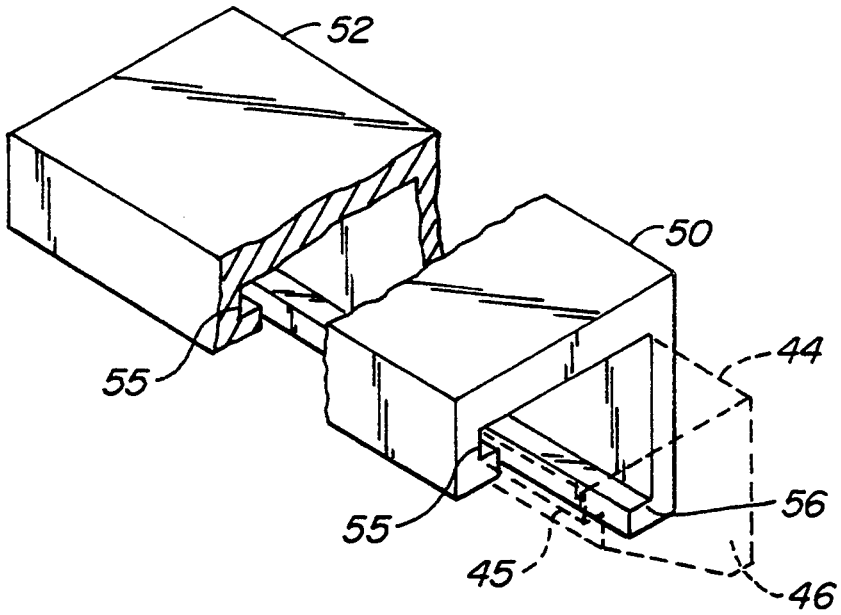
FIGS. 4A and 4B illustrate the manner in which the wing assembly is mounted to permit movement of the wing plates along the upper periphery of the moldboard.
Figure 4B:
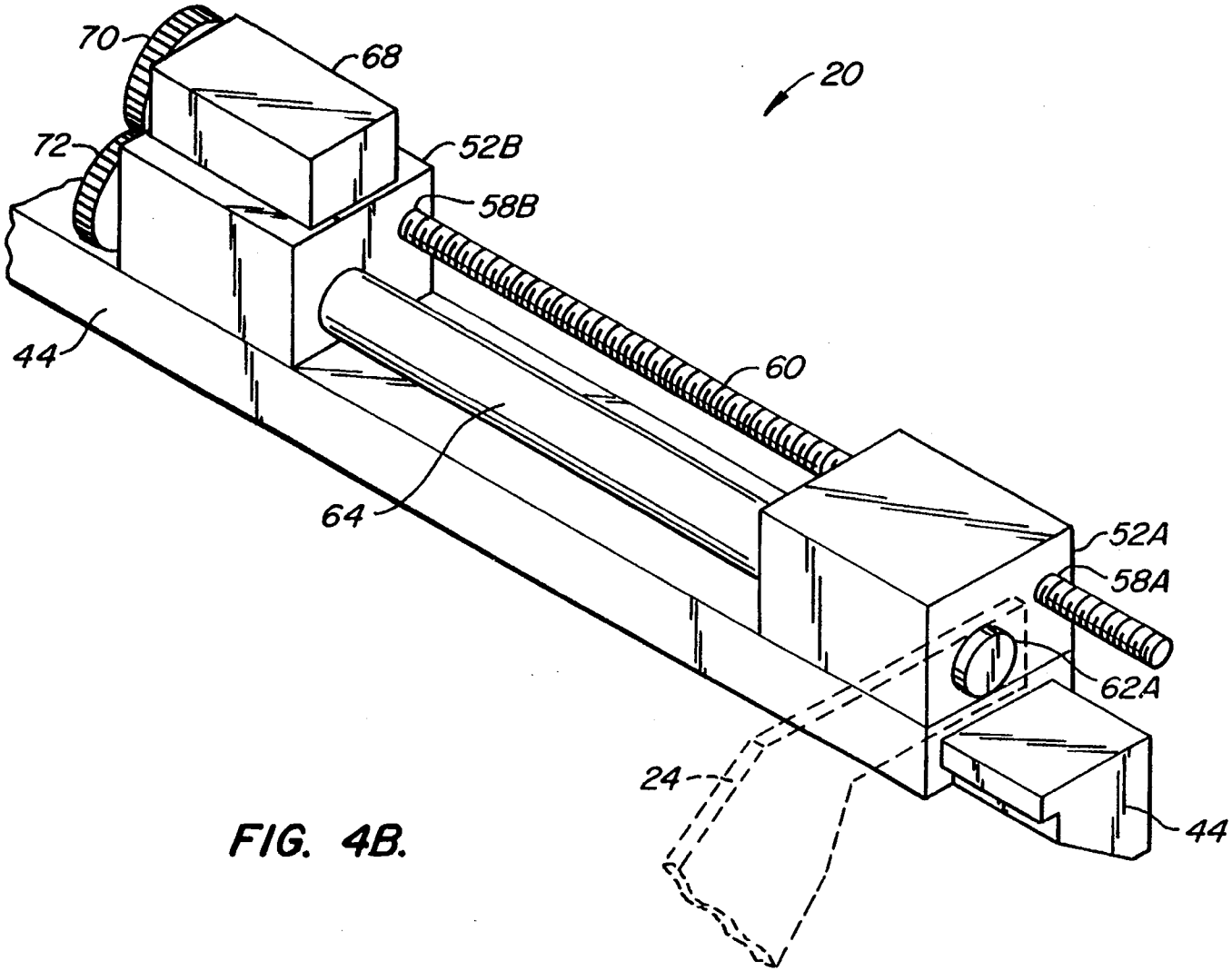
Figure 5:
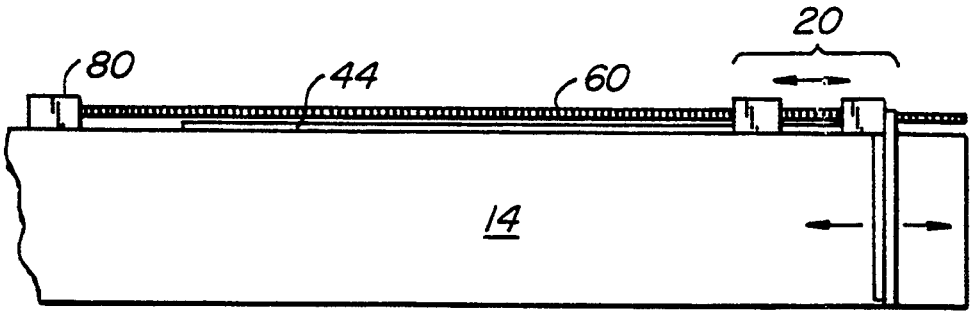
FIG. 5 illustrates the mechanism used to move the wing plate between a first position adjacent a vertical edge of the old board and a second position inward therefrom, toward the other vertical edge.

Affixed or otherwise mounted to the back surface **14*a* of the moldboard 14, and approximate the upper periphery 14*b* of the moldboard 14 is a rail structure or track 44 (see FIGS. 3 and 4, best illustrated in FIGS. 3 and 4 (shown in phantom in FIG. 4)). The track 44 has a length extends along the upper periphery 14*b* of the moldboard 14 from its vertical end, toward the center thereof (see FIG. 5). As FIGS. 3 and 4 illustrate, the track 44 has formed thereon longitudinally extending lands 45, 46**.

The carriage mechanism 20 includes a pair of slide blocks, 50, 52, mounted on the track 44, each of which includes lands 54, 56 shaped and configured to receive the flanges 45, 46 of the track 44. The cooperative relationship between the land 55, 56 and the flanges 45, 46 may respectively receive or cooperate with, operate to hold the slide bar locks against rotation (for reasons that will become clear below), but yet allow them to slide along the upper periphery **14*b* of the slide board 14**.

Mounted on the slide bar 50, for movement therewith, are journal blocks 52A and 52B. Horizontally formed in each of the journal blocks 52A, 52B are internally threaded through bores 58A, 58B, respectively that receives an elongate, externally threaded bar 60. It is rotation of the bar 60, together with the engagement of the external threads formed on the outer surface of the bar 60 with the threads formed in the through bores 58A, 58B that moves the carriage mechanism 20 along the upper periphery 14*b* of the moldboard 14.

The journal blocks 58A, 58B, also have formed therein journals 62A, 62B that receive and hold the end portion of a lift bar 64 that, in turn, is configured at its end to be held by the journal blocks 52A, 52B for rotation therein. In this connection, mounted on the inner journal block 52B is a hydraulic motor 68, an off the shelf item, configured to rotate a drive wheel 70. Drive wheel 70, in turn, engages and operatively drives a ground gear 72 which is affixed to one end of the lift bar 64. As indicated above, the other end of the lift bar 64 has coupled thereto the wing plate attachment arm 24.

When actuated, the hydraulic motor 68 will operate to drive gears 70, 72 to rotate the lift bar 64, in turn, lifting the wing plate 22, and with it the second wing plate 34. As indicated above, operation of the hydraulic motor 68 effects adjustment of the cutting edge 32 of the wing plate 22 to accommodate the position of the concave surface of the moldboard 14. The hydraulic clamp 40 is operated to release the clamped relationship between the two wing plates 22, 34 of the assembly, and the wing plate 22 lifted the desired amount; the weight of the wing plate 34 will tend to hold it in place (i.e., with the cutting edge proximate the concave surface of the moldboard 14) and the guide posts 36 will keep the wing plates 22, 34 together. When the wing plate 22 is positioned as desired, the clamp 40 is operated to clamp the wing plates fixedly together. The hydraulic motor 68 will tend to hold the cutting edge of the wing plate 34 (in addition to its own weight) to the concave surface of the moldboard 14.

In the same manner the wing plate assembly 18 may be moved out of the way when no longer needed. The two wing plates are kept clamped by the hydraulic clamp 40, and the hydraulic motor operated to lift both of then upward, positioning them vertically away from the concave surface of the moldboard 14. Of course, the wing assembly may be removed entirely from the moldboard, if so desired.

Movement of the carriage mechanism 20 along the old board 14 (in a direction parallel to the long dimension of the moldboard) is effected by a hydraulic motor 80 (FIG. 5), which is mounted proximate the center of the moldboard 14, and coupled to receive and rotate the externally threaded bar 60. Thus, actuation of the hydraulic motor 80 will operate to circumferentially rotate the externally threaded bar 60 to, in turn, cause the bar to be threaded into, or out of, the internally threaded through bore 58A, 58B of the journal blocks 52A, 52B. Depending upon the direction of rotation of the bar 60, effected by the hydraulic motor 80, the journal blocks 52A, 52B will be pulled or pushed along the track 44, moving the wing plates 22, 34 inward toward the center of the moldboard 14, or outward to a position proximate the end of the moldboard.

In summary, therefore, there has been disclosed a wing assembly for one or both side ends of a moldboard or grader blade of material moving equipment. The wing assembly includes a pair of flat wing plates coupled together for expansion or contraction, adjusting for changes in attitude of the moldboard as necessary. In addition, the adjustment of the wing plates is done in a manner that maintains a cutting edge of the wing plates generally parallel with the ground surface. Further, the wing assembly is constructed to be movable between a position adjacent the corresponding side end of the moldboard, and a position inward toward the middle of moldboard.

It will be appreciated by those skilled in this art that although the invention has been disclosed for use in connection with a moldboard of a grader, its use should not be considered limited to graders. For example, the invention may also find applicability on the blade of dozers, and other material-moving equipment, although the structural integrity of the wing members may need to be bolstered to accommodate the higher power normally found in dozer equipment.

While a full and complete disclosure of the invention has been made herein, it will be also evident to those skilled in this art that various alterations and modifications can effected. For example, while it is preferred that the various actuating element (i.e, plate clamp 40, the wing plate lift motor 68, or the side-shift motor 80) are hydraulically operated, using electro-mechanical devices for flow control, other actuating devices could also be use such as, for example, electric motors. Thus, the scope of the invention should not be taken as being limited by what is disclosed, but should only by the following claims.

What is claimed is:

1. A wing assembly for use with a moldboard of material moving equipment, the moldboard being of the type having a concave, horizontally extending material moving surface, the wing assembly comprising:

means for mounting the assembly to the moldboard in a manner that permits movement of the wing assembly along the material moving surface of the moldboard;

a first wing plate, of substantially planar construction forming a first planar surface, journalled to the mounting means and relative to the material surface for movement in a plane generally perpendicular to the material surface and parallel to the first surface;

a second, planar wing plate mounted juxtaposed to the first wing plate in a manner that permits the first wing plate to be moved relative to the second wing plate; and moving means coupled to the assembly for moving the first wing plate toward or away from the material surface of the moldboard.

2. The wing assembly of claim 1, wherein the moving means includes a hydraulic motor means.

3. The wing assembly of claim 1, including means for releasably affixing the first and second wing plates to one another.

4. The wing assembly of claim 3, wherein the affixing means includes a hydraulic clamp.

5. The wing assembly of claim 1, including further means for moving the wing assembly horizontally along the moldboard.

6. The wing assembly of claim 5, wherein the further means for moving includes an elongate, externally threaded rod having a longitudinal axis, and means for circumferentially rotating the rod about the longitudinal axis, and including carriage means mounted to the moldboard for movement along the horizontally extending material surface of the moldboard and having formed therein a threaded aperture that receives the externally threaded rod, whereby circumferential rotation of the rod will effect horizontal movement of the carriage assembly along the material surface of the moldboard in a direction determined by the direction of rod rotation, and means mounting the first wing plate to the carriage assembly.

7. A wing assembly for use in combination with a moldboard of material moving equipment, the moldboard being of the type having a concave, horizontally extending material moving surface defined by at least an upper horizontally extending periphery between ends of the moldboard, the wing assembly comprising:

carriage means mounted to the moldboard proximate to and for movement along the upper periphery;

means, mounted to the moldboard, and coupled to the carriage means, for moving the carriage means along the upper periphery;

a wing plate means mounted to the carriage for movement therewith between a first position that places the wing plate means proximate one of the ends of the moldboard and a second position away from the one of the ends of the moldboard and toward the other of the ends of the moldboard, the wing plate means having at least one planar surface oriented generally perpendicular to the material moving surface of the moldboard.

8. The wing assembly of claim 7, including means for journalled attachment of the wing plate means to the carriage for movement of the planar surface between a one position that places an edge periphery of the planar surface in proximate relation with the material surface of the moldboard and another position that places the edge periphery a predetermined distance from the material surface.

9. The wing assembly of claim 7, wherein the wing plate means includes first and second wing plates affixed together by means that releasably holds the first and second wing plates in sliding arrangement with one another, the first wing plate being journalled to the carriage for movement perpendicular to the moldboard, the second wing plate having formed thereon an edge periphery that conforms to the concave material surface, the peripheral edge being located in juxtaposed relation to the material moving surface of the moldboard.

10. The wing assembly of claim 9, including a second wing assembly of substantially identical design mounted proximate the other of the ends of the moldboard, the second wing assembly having second wing means mounted adjacent the other of the ends of the moldboard moveable from a first position proximate the other of the ends of the moldboard and a second position distant from the other of the ends of the moldboard toward the one of the ends.

11. A wing assembly for use with a moldboard carried by a material moving vehicle, the moldboard being of the type having a material moving surface bounded by at least an upper elongate, horizontal edge that extends between a pair of spaced, vertical edges, the wing assembly comprising:

a carriage element mounted to the moldboard proximate a one of the pair of the vertical edges of the moldboard;

wing plate means pivotally coupled to the carriage element and positioned to have a planar dimension that extends from the material moving surface of the moldboard in a direction generally perpendicular to said surface, the wing plate means including at least a pair of first and second planar wing plate members affixed to one another for sliding movement in parallel planes, the first wing plate having an edge configured and placed in vertically oriented position, and juxtaposed with the material moving surface of the moldboard;

means for releasably holding the first and second wing plate members immovable relative to one another; and means coupled to the carriage and the second wing plate member for moving the second plate member selected distances away from the material moving surface of the moldboard in a plane generally perpendicular to the horizontal edge of the moldboard.

12. The wing assembly of claim 11, wherein the carriage element includes means for movement of the carriage element along the horizontal edge between a first position proximate the one of the vertical edges and a second position a predetermined distance from the one of the vertical edges and toward the other of the vertical edges.

13. The wing assembly of claim 12, wherein the coupling means includes a hydraulic clamp for releasably holding the first and second wing plate members immovable to one another.

14. A wing attachment to a grader blade carried by a material moving vehicle, the grader blade being of the type having a material moving surface bounded by at least an upper elongate, horizontal edge that extends between a pair of spaced, vertical edges, the wing attachment comprising:

a pair of wing assemblies each mounted proximate an associated one of the vertical edges of the grader blade, and each wing assembly including:

a carriage element mounted to the grader blade proximate a one of the pair of the vertical edges of the moldboard;

wing plate means pivotally coupled to the carriage element and positioned to have a planar dimension that extends from the material moving surface of the grader blade in a direction generally perpendicular to said surface, the wing plate means including at least a pair of first and second planar wing plate members affixed to one another for sliding movement in parallel planes, the first wing plate having an edge configured and placed in vertically oriented position, and juxtaposed with the material moving surface of the grader blade;

means for releasably holding the first and second wing plate members immovable relative to one another; and means coupled to the carriage and the second wing plate member for moving the second plate member selected distances away from the material moving surface of the grader blade in a plane generally perpendicular to the horizontal edge of the grader blade.

15. The wing assembly of claim 14, wherein the carriage element includes means for movement of the carriage element along the horizontal edge between a first position proximate the one of the vertical edges and a second position a predetermined distance from the one of the vertical edges and toward the other of the vertical edges.

16. The wing assembly of claim 15, wherein the coupling means includes a hydraulic clamp for releasably holding the first and second wing plate members immovable to one another.

17. A wing assembly for use with a material moving, elongate blade element of material moving equipment, the blade element being of the type having a concave, horizontally extending material moving surface, the wing assembly comprising:

means for mounting the assembly to the blade element in a manner that permits movement of the wing assembly along the material moving surface of the blade element;

a first wing plate, of substantially planar construction forming a first planar surface, journalled to the mounting means and relative to the material surface for movement in a plane generally perpendicular to the material surface and parallel to the first surface;

a second, planar wing plate mounted juxtaposed to the first wing plate in a manner that permits the first wing plate to be moved relative to the second wing plate; and moving means coupled to the assembly for moving the first wing plate toward or away from the material surface of the blade element.

18. The wing assembly of claim 17, wherein the blade element is a moldboard.

19. The wing assembly of claim 17, wherein the blade element is a grader blade.

* * * * *